US005671500A

United States Patent [19]

Balk

[11] Patent Number: 5,671,500

[45] Date of Patent: Sep. 30, 1997

[54] OVERHEAD DOOR SPRING SHIELD SYSTEM

[76] Inventor: Brett Balk, 726 S. Covell, Sioux Falls, S. Dak. 57104

[21] Appl. No.: 511,993

[22] Filed: Aug. 7, 1995

[51] Int. Cl.[6] ..... E05F 1/08

[52] U.S. Cl. ..... 16/72; 16/DIG. 1; 16/76; 160/191

[58] Field of Search ..... 16/72, DIG. 1, 16/75, 76, 77, DIG. 7; 160/191, 192; 49/200

[56] References Cited

U.S. PATENT DOCUMENTS

| | | | |
|---|---|---|---|
| 2,194,111 | 3/1940 | Blodgett | 160/191 |
| 3,285,673 | 11/1966 | Dobrikin | 303/22 |
| 3,353,817 | 11/1967 | Bollinger | 267/69 |
| 3,860,226 | 1/1975 | Hensiek, Jr. | 267/69 |
| 4,082,133 | 4/1978 | Halopoff | 160/191 |
| 4,601,131 | 7/1986 | Ozols | 49/206 |
| 4,640,049 | 2/1987 | Duncan | 49/197 |
| 4,731,905 | 3/1988 | Milano et al. | 49/200 |
| 4,757,853 | 7/1988 | Price | 160/191 |
| 4,783,929 | 11/1988 | Blubaugh | 49/206 |
| 4,969,542 | 11/1990 | Athmer et al. | 188/322 |
| 5,239,777 | 8/1993 | Husselton | 160/191 |
| 5,419,010 | 5/1995 | Mullet | 160/191 |

*Primary Examiner*—Chuck Y. Mah

[57] ABSTRACT

The invention relates to a design for covering and protecting an overhead door spring assembly from the coercive and deteriorating effects caused by the environment that overhead spring assembley's operate in. This includes preventing rust accumulation and deterioration of the spring assembly. The invention includes a tubular telescopic cover and bearing for a spring assembly that is water resistant and prevents rust from accumulating and dripping on vehicles below the door.

11 Claims, 4 Drawing Sheets

OVERHEAD DOOR SPRING SHIELD SYSTEM

FIELD OF THE INVENTION

The invention relates generally to spring assemblies for overhead doors and more particularly to a tubular telescopic cover and bearing for a spring assembly that is water resistant and prevents rust from accumulating and dripping on vehicles below the door.

BACKGROUND OF THE INVENTION

The invention relates to protecting an overhead door spring assembly from the coercive and deteriorating effects caused by operating environments. These door assemblies rust quickly when left unprotected. Spring assemblies deteriorate and discharge accumulated rust and other foreign matter on vehicles as they pass underneath, Continued exposure of a spring assembly to the surrounding environment decreases life expectancy, thereby, necessitating replacement. Long term exposure to environments such as this can cause the spring assembly to freeze up. This causes them to be non-functional.

Related art regarding protective coverings for overhead door springs exist. These inventions generally include some kind of shroud disposed about a coiled spring. These devices function as safety features in the event the coiled spring breaks.

U.S. Pat. No. 3,860,226 issued to Hensiek in 1975 describes an overhead door counterbalance assembly that includes a coiled spring protectively encapsulated in a tube. Each end is joined to a linkage assembly by a connecting means sufficient to alternately increase or decrease tension as the door is dosed or opened. The shroud is not removable.

Other safety devices include a tubularly encapsulated spring assembly that includes a flexible member that extends through each coil spring. U.S. Pat. No. 3,353,817 issued to Bollinger in 1967 describes an elastic extension device that includes a coiled rope contained within a sleeve, the rope extending through each end of the sleeve. The device operates as a shock absorbing mechanism that can be used in a variety of circumstances. These devices are designed to absorb shock and are not specifically intended to prevent exposure to the dilatory effects of a wet environment.

Variations of this principal are disclosed in U.S. Pat. No. 4,783,929 issued to Blubaugh that describes a spring assembly vertically mounted to an assembly for raising and lowering a garage door. The spring assembly being shrouded inside guard halves. U.S. Pat. No. 4,601,131 issued to Ozols in 1985 describes a counterbalance spring device that consists of an encapsulated compression spring integrated with a movable pulley by a cable that causes the cable to pull on the pulley resulting in compression of the spring when the door is closes. The use of this configuration provides some degree of safety in that there is little likelihood the spring will fracture.

It can be clearly seen in related art that encapsulation is primarily used as a safety feature in these inventions. Shrouds are not designed to be removable, but are designed to absorb shock in the event a spring breaks. Moreover, the covers on the afore mentioned inventions are not specifically designed to be used in a car wash type environment and thus are not necessarily constructed out of material resistant to water.

Other designs of spring assemblies incorporate safety features but do not utilize encapsulation. One device includes a rod extending through the center of the spring and grounded at each end to absorb the initial shock and impact resulting from fracturing of the spring. Another device utilizes a safety cable extending through the center of the anchored coiled spring so that movement of the spring is minimized if fracturing occurs.

The need exists for an encapsulation design suitable for use in wet environments. The need also exists for a shroud that is removable giving access to the inner spring assembly. These are objectives not addressed in the prior related art.

SUMMARY OF THE INVENTION

One object of the invention is to make a water resistant cover for spring assembly systems used as counterbalances for doors.

Another object is to make such a system that is both efficient and inexpensive to manufacture. This kind of system would be affordable and functional for the consumer.

A further object is to create a tubular cover system that reduces rust on the door assemblies and keeps rust from dripping down on the ground and on vehicles that may be underneath. This kind of design is well suited to use in a car wash environment.

Another object of the invention is to devise a shield cover that is lightweight and easy to manufacture. The cover must also not interfere with the function of the spring system as it acts as a counterbalance.

Still another object is to increase the useful life of a spring assembly by encapsulating it preventing deterioration of functional components and preventing it from freezing up.

Yet another object is to design a cover that affords some safety protection to users in absorbing the shock of the spring assembly if it fails.

Another object of the invention is to make the cover adjustable, easily removable and providing easy access to the spring assembly.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentality's and combinations particularly pointed out in the appended claims.

The instant invention includes a tubular cover protecting a spring shield system for overhead doors. The system has frictionally interlocking tube covers that enclose the spring assembly of standard or custom sized overhead doors from moisture and dirt. The spring assembly serves as a counterbalance for a mechanized system used to raise and lower the doors. The tubular cover also requires at least one bearing, preferably made of nylon, sized to permit a rod pass through and rotate. This permits the rod to pass through the tubular cover but engages the coiled spring to counterbalance a means used to open or close the door.

The present invention is designed to shield the assembly in a wet environment preventing rust. The tubularly shaped cover extends the substantial length of the spring shielding the spring assembly from water and exposure to the elements. A bearing is attached to one end of the cover to permit a rod to extend through the assembly allowing the spring assembly to act as a counterbalance.

DETAILED DESCRIPTION OF THE PREFERRED EMBODIMENTS

Figure 1:
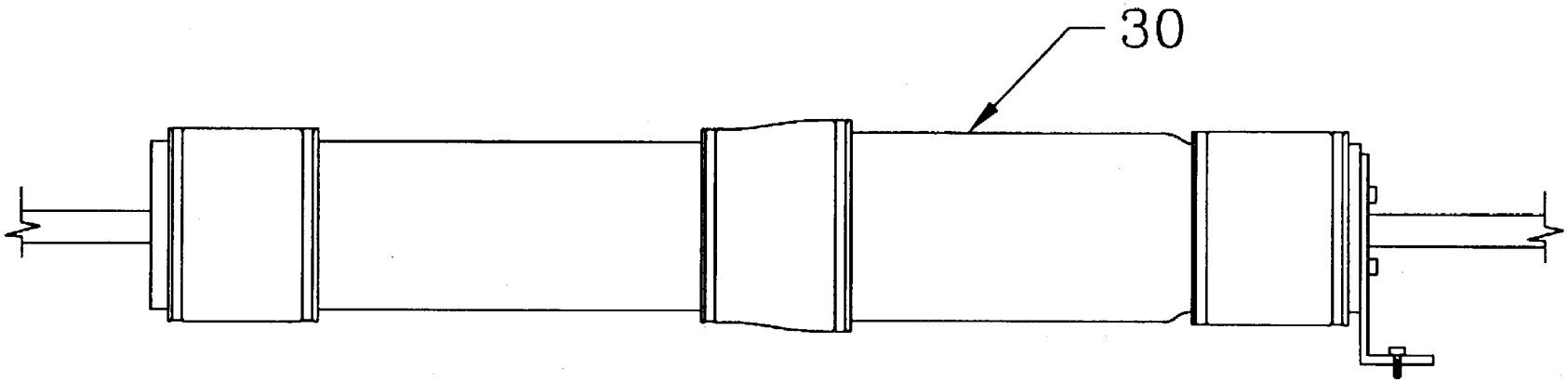
FIG. 1 is a side view of the spring shield cover showing the tubular pieces fitted into the clamped rubber couplers.
Figure 2:
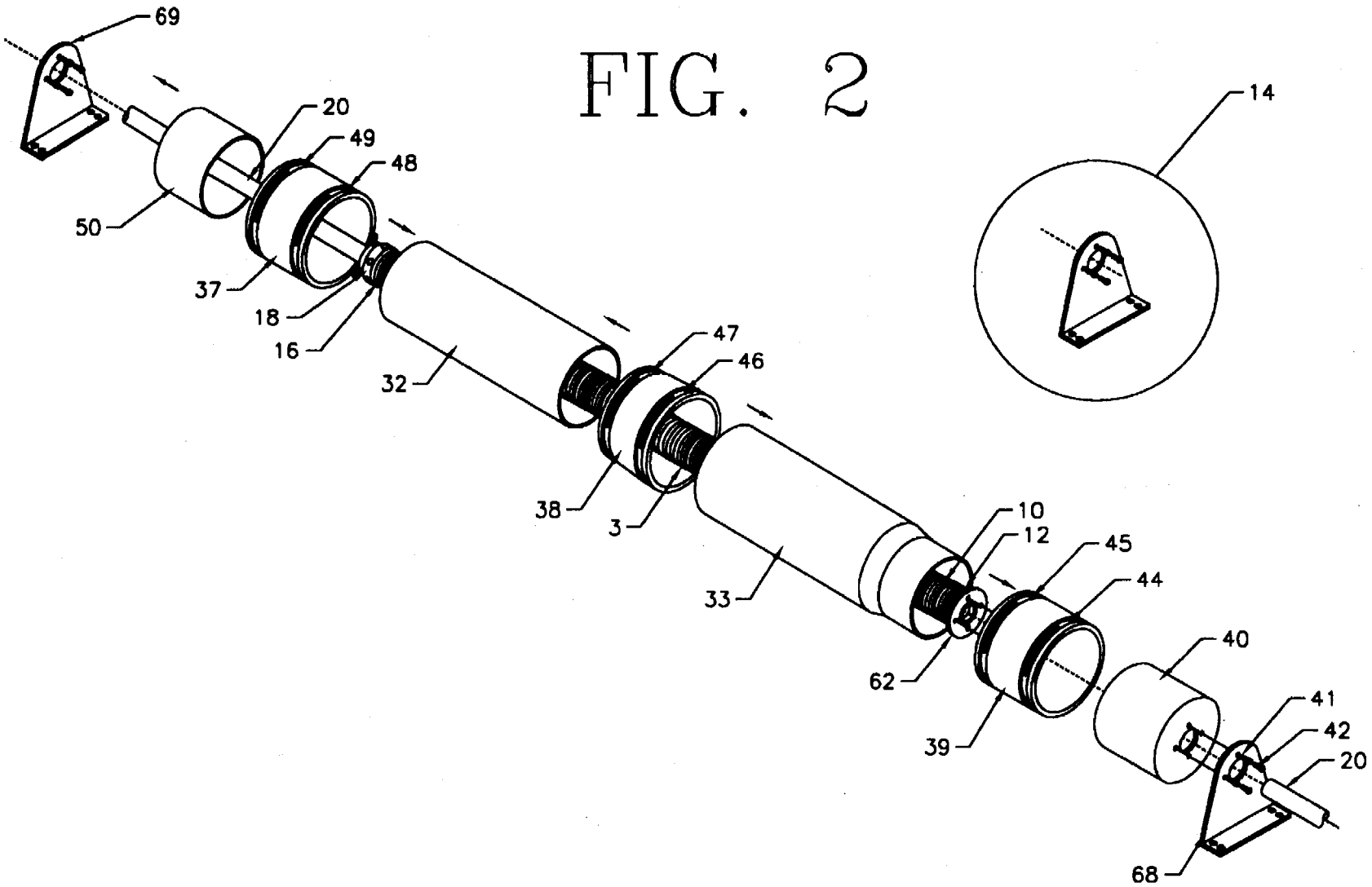
FIG. 2 is an exploded view of the cover and couplers with the rod extending through the bore of the spring assembly. The anchoring assembly is shown as it attaches to the wall bracket.

The inventive features of the apparatus are schematically incorporated illustratively now in FIGS. 1–4. The overhead door spring shield system 1 incorporates improvements into a counterbalance system designed to protect spring assemblies from the elements and to provide easy access for maintenance purposes. The primary features of the improvements shown in FIG. 1 include frictionally interlocking tube covers 32 and 33 fixedly held to an access cap 50 and an anchor cap 40 on each end by rubber couplers 37–39. The access cap is also attached to a bearing 52 that permits a rod 20 to rotate through the bore of the assembly.

Figure 3:
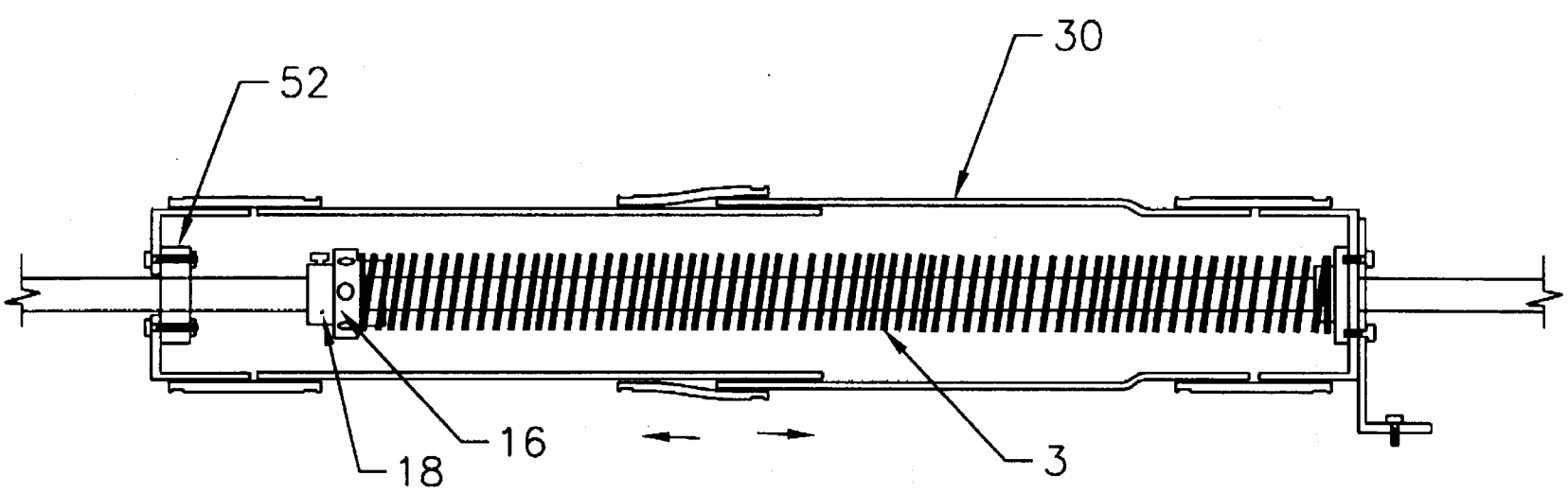
FIG. 3 is a side view of the cover and the spring assembly including the adjustable locking assembly secured to the rod. The bearing is shown attached to one end providing a surface suitable for the rod to freely rotate.
Figure 4:
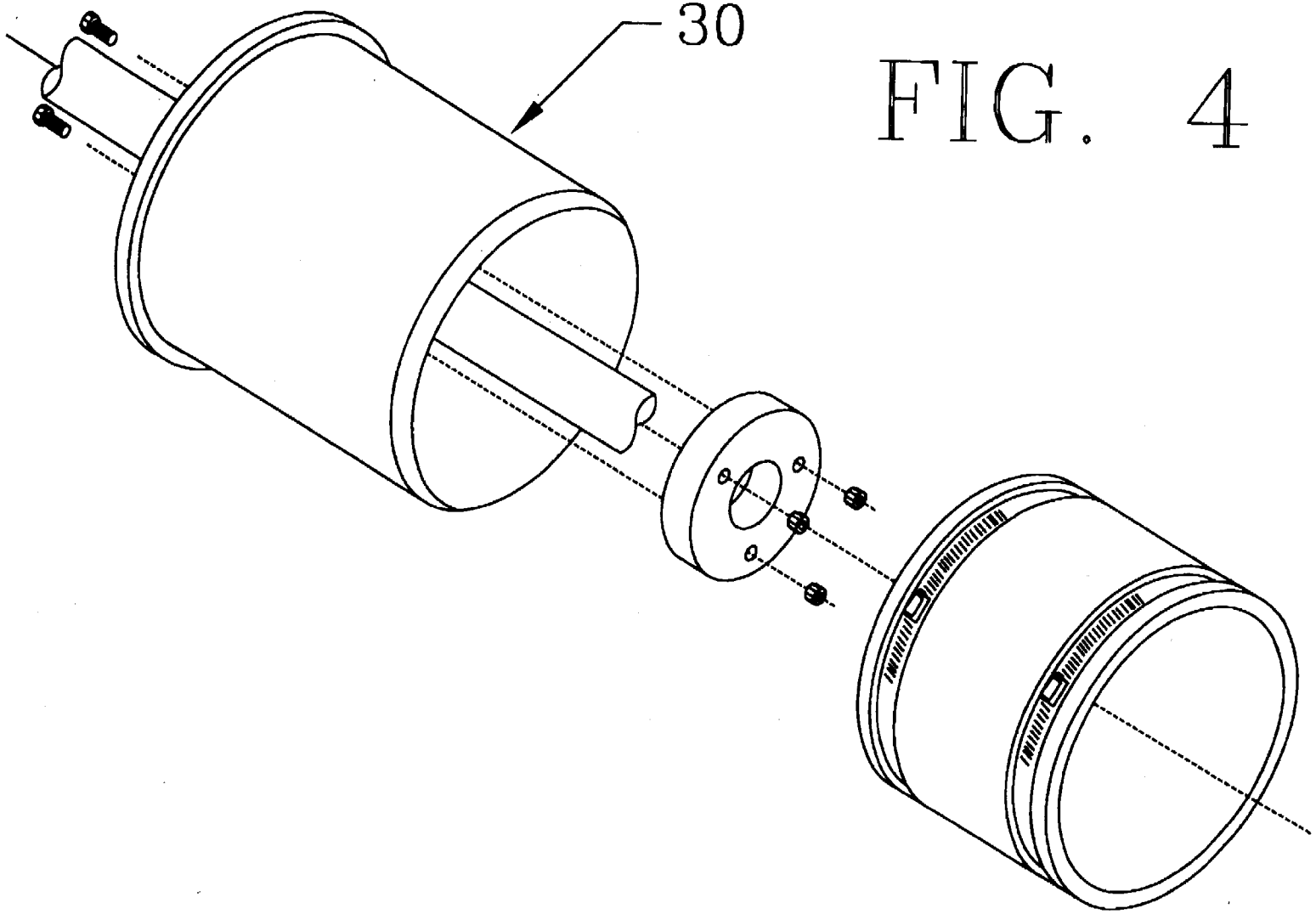
FIG. 4 is an expanded view of the rod extending through the bearing and the cover as it integrates with the banded rubber coupler.

The improvements of this invention are incorporated into the counterbalance mechanism of a standard overhead door assembly shown in FIGS. 1 and 3. The spring assembly includes a heavy duty elongated coiled spring 10. The spring must be sturdy yet resilient. The spring is compressed or stretched alternately as the door is either opened or closed.

The present invention is specifically designed to be used in a car wash environment. The instant apparatus is transversely placed overhead between two spools of cable attached to each side of a door. The door is opened or closed by winding or unwinding the cable in the spool. The tension in the counterbalance can be adjusted to affect the ease with which the door can be opened or closed. The principles of this design may be applied to other door designs and need not be restricted to the specific embodiment of this particular door design.

The spring 10 is grounded at both ends. The first end of the spring is held by a bracket 12 that includes an opening that functions as a bearing through which the rod 20 pivotally passes. The bracket also includes one or more threaded openings for screws 41 and 42 that attach the spring 10 to an anchor cap 40 and a wall mounting bracket 68. The anchor cap and wall mounting bracket also include openings through which the rod can pass and rotate about.

The other end of the spring 10 is stationary held by a second end bracket 16. This bracket is shown in FIG. 3 and likewise includes openings through which the rod can pass and rotate about. The bracket 16 is attached to an adjustable lock 18 that is able to clamp to the rod 20 so that this end of the spring assembly rotates with the rod. The rod is able to axially rotate in alternate directions at different times stretching when the door is opened and contracting when the door is closed, The rod 20 extends through the bore of the coiled spring 10 and is pivotally attached at each end to a door frame mount 24 and 26. The rod can be axially rotated in alternate directions when the door is opened or closed thereby stretching the spring 10 when the door is opened and contracting it when the door is closed.

The spring assembly 3 is protected by a tubularly shaped cover 30. The cover extends the substantial length of the spring. The purpose of the cover is to shield the spring assembly from water and exposure to the elements. In the preferred embodiment the cover is made of plastic, preferably PVC pipe. The plastic can be custom cut to the size of the spring assembly that must be covered. Most spring assemblies are of a standard size so that cover sizes can be pre-cut by machine at a very reasonable price. The cover tube could also be made of other materials, such as stainless steel.

The cover tube should be made of two end caps 40 and 50 plus at least one additional tubular portion. The preferred embodiment includes a plurality of telescopic plastic tubes, with two being the most preferred number. Two is the ideal number because it is sufficient to cover most standard sized spring assemblies and it provides for easy disassembly during maintenance. The tube covers should be frictionally interlocking pieces of PVC plastic.

The cover tubes interlock with one another in one embodiment and are held in place by the gasket like action of the inner surface of one cap or tube frictionally interfaced with the outer surface of the tube or cover to which it is joined. The most preferred embodiment interpose one or more rubber couplings with accompanying stainless steel hose clamps between the caps and tubular covers. This arrangement provides a sturdy link between the parts of the cover, protects from seepage of water into the seems, and is easily disassembled.

One embodiment of the spring tube protection cover includes a single tubular portion interlocked with the two end caps. In this design the center tubular portion can also include at least one opening cut in the side. This provides access to the inner spring assembly allowing the performance of maintenance or repair functions without disassembling the cover. In this embodiment the tube cover must be supplied with plastic plugs to cover the openings when these functions are not being performed so that the inner assembly is protected from exposure to water or other elements.

One other feature of the overhead door spring shield system relates to an internally mounted bearing 52 attached to the access cap. The bearing must be of sufficient inner circumference to permit the outer surface the rod to rotate as it passes through. The bearing must be durable yet cause minimal friction with the rod. The bearing is made of nylon in the preferred embodiment of the invention.

The invention further discloses a method of constructing a protective overhead door spring shield system for standard sized spring assemblies. The steps of this method including providing a standard sized spring assembly. This assembly can be comprised of an elongated coiled spring with a rod attached to a door frame extending through the center bore secured fixedly at one end to an anchoring means and pivotally on the other end to the rod.

The invention of this method then resides further in the steps of covering the spring assembly with a tubularly shaped spring protection cover. In one embodiment the steps of making telescopically assembled plastic members frictionally held together by rubber couplers using stainless steel hose clamps is required. The remaining step is attaching a bearing to an anchor cap on one end of the tube that supports it and permits the rod to rotate through the bearing.

Another embodiment of this method includes the steps of cutting elongated openings in the tubular cover and supplying plastic plugs to cover the openings permitting access for maintenance or repair.

I claim:

1. An overhead door spring shield system comprising:

a spring assembly including an elongated coiled spring having a fixedly held first end and a second end attached to an adjustable lock;

a rod extending through a center bore of the coiled spring and pivotally attached on each end to a door frame mount, the adjustable lock being fixedly attached to the rod at a point so that the second end of the spring rotates with the rod when the door is opened or closed;

a tubularly shaped spring protection cover having opposing first and second ends extending the substantial length of the spring assembly shielding it from exposure to airborne moisture, the length of the spring protection cover between the first and second ends being adjustable without requiring the removal of the protection cover from about the coiled spring;

an anchor cap having an opening sized to fit over the first end of the spring protection cover;

an access cap having an opening sized to fit over the second end of the spring protection cover; and bearing means attached to the access cap and defining a second opening in the access cap through which the rod passes to permit rotation of the rod relative to the access cap.

2. An overhead door spring shield system according to claim 1 where said spring protection cover includes at least two tubular cover pieces, one tubular cover piece being slidably nested in another tubular cover piece for providing access and permitting performance of maintenance functions on the spring assembly without removing the cover.

3. An overhead door spring shield system, comprising:

a spring assembly including an elongated coiled spring having a fixedly held first end and a second end attached to an adjustable lock;

a rod extending through a center bore of the coiled spring and pivotally attached on each end to a door frame mount, the adjustable lock being fixedly attached to the rod at a point so that the second end of the spring rotates with the rod when the door is opened or closed;

a tubularly shaped spring protection cover having opposing first and second ends extending the substantial length of the spring assembly shielding it from exposure to airborne moisture;

an anchor cap having an opening sized to fit over the first end of the spring protection cover;

an access cap having an opening sized to fit over the second end of the spring protection cover; and bearing means attached to the access cap and defining a second opening in the access cap through which the rod passes to permit rotation of the rod relative to the access cap;

where said spring protection cover includes a plurality of frictionally interlocking pieces of plastic.

4. An overhead door spring shield system according to claim 3 where one or more stainless steel hose clamps are disposed about one or more tubular rubber coupling members that are interposed between said interlocking plastic pieces; the hose clamps can be alternately tightened or loosened to hold the plastic pieces in a fixed position covering the coiled spring.

5. An overhead door spring shield system according to claim 2 where the spring protection cover is supplied with plastic plugs to cover the openings at the first and second ends of the protection cover.

6. An overhead door spring shield system according to claim 3 where said bearing means is made of nylon.

7. An overhead door spring shield system, comprising:

an elongated coiled spring having a first end attached to a first anchoring means for fixedly holding the first end of the spring stationary and a second end connected to an adjustable lock means, the spring being of suitable size and strength to function as part of an inner spring assembly serving as a counterbalance for opening and closing an overhead door;

a rod extending through a center bore of the coiled spring and pivotally attached on each end to a door frame mount, the adjustable lock means being connected to the rod at a point between the two ends of the to secure the second end of the spring to the rod in a manner such that the rod is able to axially rotate in alternate directions at different times stretching when the door is opened and contracting when the door is closed;

a tubularly shaped spring protection cover having opposing ends extending the substantial length of the spring and of sufficient size to house the coiled spring to thereby shield it from exposure to airborne moisture;

an anchor cap sized to fit over one end of the spring protection tube and attached to the first anchoring means, the cap including an opening with diameter wide enough to permit passage of the rod through it;

an access cap sized to fit over the opposing end of the spring protection tube, the cap including an opening with diameter wide enough to permit passage of the rod through it; and bearing means attached to the access cap and located at the opening in the access cap through which the rod passes to permit rotation of the rod relative to the access cap;

where said spring protection cover includes a plurality of frictionally interlocking pieces of plastic.

8. An overhead door spring shield system according to claim 7 where one or more stainless steel hose clamps are disposed about one or more tubular rubber coupling members that are interposed between said interlocking plastic pieces; the hose clamps can be alternately tightened or loosened to hold the plastic pieces in a fixed position covering said spring assembly.

9. An overhead door spring shield system according to claim 7 where the spring protection cover includes at least one opening providing access and permitting performance of maintenance functions on the spring assembly without removing the cover.

10. An overhead door spring shield system according to claim 9 where the spring protection cover is supplied with plastic plugs to cover the openings in the anchor and access caps.

11. An overhead door spring shield system according to claim 7 where the bearing means is made of nylon.

* * * * *